United States Patent [19]

Billingsley et al.

[11] Patent Number: 4,499,887

[45] Date of Patent: Feb. 19, 1985

[54] DUAL FUEL SUPPLY SYSTEM

[75] Inventors: Henry C. Billingsley, Waukegan, Ill.; Amos M. Clark, Kenosha, Wis.

[73] Assignee: Outboard Marine Corporation, Waukegan, Ill.

[21] Appl. No.: 461,866

[22] Filed: Jan. 28, 1983

[51] Int. Cl.[3] ..... F02M 13/04

[52] U.S. Cl. ..... 123/575; 123/1 A; 123/179 G; 123/515

[58] Field of Search ..... 123/575, 187.5 R, 179 G, 123/1 A, 27 GE, 515

[56] References Cited

U.S. PATENT DOCUMENTS

| | | | |
|---|---|---|---|
| 2,616,404 | 11/1952 | Bartholomew | 123/179 G |
| 2,643,647 | 6/1953 | Meyer et al. | 123/575 |
| 2,664,871 | 1/1954 | Anderson | 123/575 |
| 4,056,087 | 11/1977 | Boyce | 123/575 |
| 4,085,720 | 4/1978 | Etoh | 123/575 |
| 4,090,484 | 5/1978 | Itoh et al. | 123/575 |
| 4,129,620 | 12/1978 | Etoh | 123/179 G |
| 4,264,536 | 4/1981 | Yoshioka et al. | 123/187.5 |
| 4,340,549 | 7/1982 | McKim | 123/575 |
| 4,347,195 | 8/1982 | Ogawa | 123/575 |
| 4,373,479 | 2/1983 | Billingsley | 123/187.5 |

*Primary Examiner*—E. Rollins Cross

*Attorney, Agent, or Firm*—Michael, Best & Friedrich

[57] ABSTRACT

The dual fuel supply system for an internal combustion engine has a carburetor including a fuel/air induction passage having means defining a low pressure zone and a secondary orifice and further including a cavity communicating with the fuel induction passage through the secondary orifice. A first or primary fuel supply includes a first float bowl connected to a source of a primary fuel, such as kerosene, a first float controlled valve operable to control the supply of the primary fuel to the first float bowl, a fuel nozzle for supplying the primary fuel from the first float bowl to the low pressure zone, and a conduit connecting the first float bowl in communication with the carburetor cavity. The second or secondary fuel supply includes a second float bowl communicable with the carburetor cavity and connected to a source of a second or secondary fuel, such as gasoline, and a second float controlled valve operable to control the supply of the secondary fuel to the second float bowl. In one embodiment, the carburetor includes a throttle valve located downstream of the low pressure zone and a priming fuel port located downstream of the throttle valve. A primer pump having an inlet connected in communication with the priming fuel port can be operated to selectively introduce a quantity of the secondary fuel into the induction passage to facilitate engine starting.

10 Claims, 1 Drawing Figure

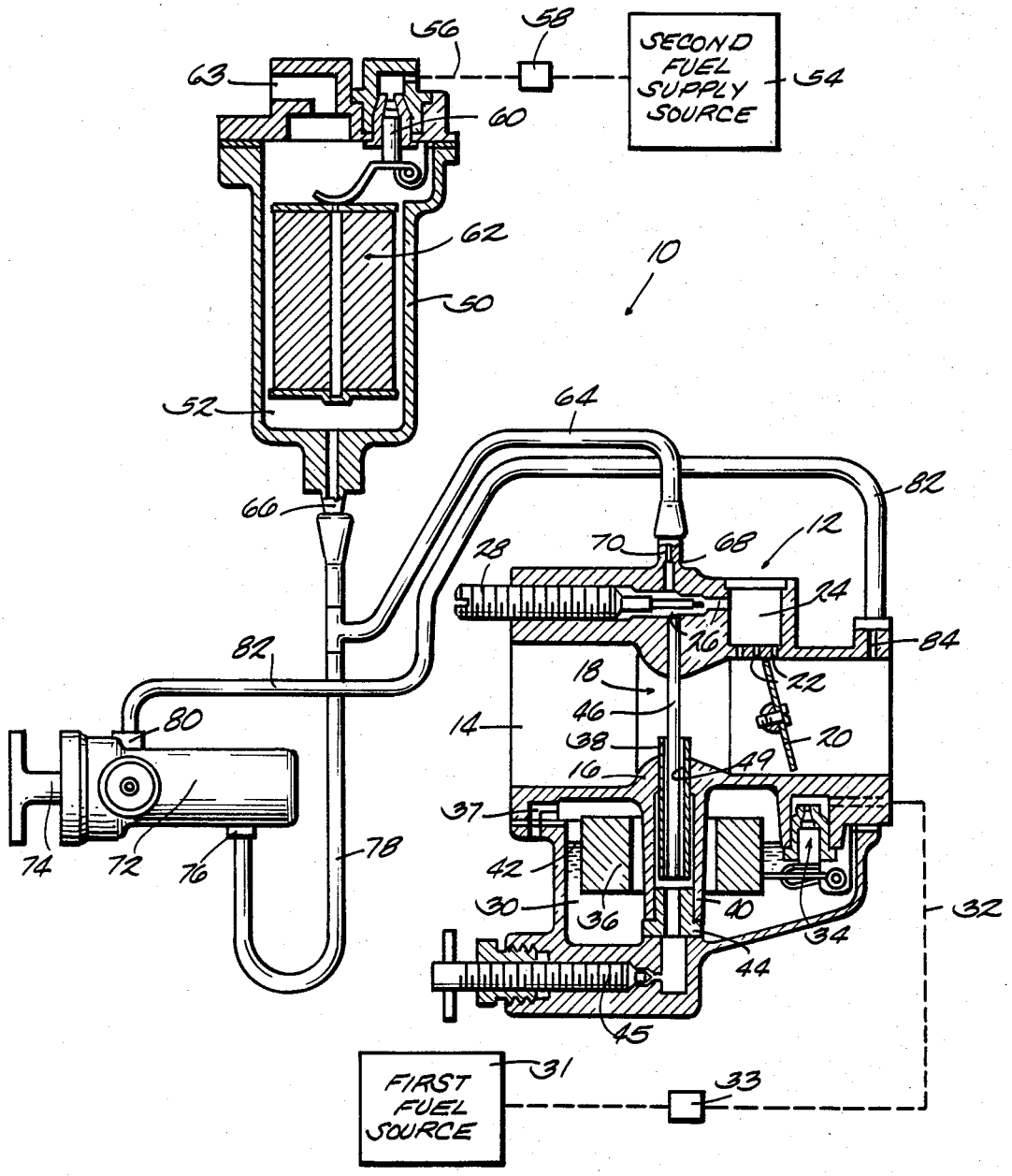
SECOND FUEL SUPPLY SOURCE
FIRST FUEL SOURCE
10
12
14
16
18
20
22
24
28
30
31
32
33
34
36
37
38
40
42
44
45
46
49
50
52
54
56
58
60
62
63
64
66
68
70
72
74
76
78
80
82
84

DUAL FUEL SUPPLY SYSTEM

BACKGROUND OF THE INVENTION

This invention relates to fuel supply system for internal combustion engines and, more particularly, to dual fuel systems operable to supply two different fuels to an internal combustion engine.

It is known to provide dual fuel supply systems capable of selectively supplying a more expensive fuel, such as gasoline, to an internal combustion engine during starting, idle and low speed operations and a less expensive fuel, such as kerosene, during low and normal speed operations.

Prior dual fuel systems are disclosed in the following U.S. patents:

| PATENTEE | U.S. PAT. NO. | ISSUE DATE |
|---|---|---|
| Bartholomew | 2,616,404 | Nov. 4, 1952 |
| Meyer, et al | 2,643,647 | June 30, 1953 |
| Anderson | 2,664,871 | Jan. 5, 1954 |
| Boyce | 4,056,087 | Nov. 1, 1977 |
| Etoh | 4,085,720 | April 25, 1978 |
| Itoh, et al | 4,090,484 | May 23, 1978 |
| Etoh | 4,129,620 | Dec. 12, 1978 |

Attention is also directed to British Pat. No. 644,721, published Oct. 18, 1950. Attention is further directed to the Billingsley et al application Ser. No. 175,348, filed Aug. 4, 1980, now U.S. Pat. No. 4,375,795 and the Haman et al application Ser. No. 406,446, filed Aug. 9, 1982, now U.S. Pat. No. 4,462,346 both assigned to the assignee of the present application.

SUMMARY OF THE INVENTION

The invention provides a fuel supply system comprising a carburetor including a fuel/air induction passage having a low pressure zone, a secondary orifice, and a well or cavity communicating with the induction passage through the secondary orifice, primary or first fuel supply means having a source of a primary fuel and means operable to simultaneously supply the primary fuel to the low pressure zone and to the cavity, and secondary or second fuel supply means including a source of the secondary fuel and means operable to supply the secondary fuel to the cavity.

In one embodiment, the primary fuel supply means includes a first float bowl communicating with the low pressure zone and with the cavity and a first float controlled valve communicable with the primary fuel source and operable to control the supply of the primary fuel to the first float bowl, and the secondary fuel supply means includes a second float bowl communicating with the cavity and a second float controlled valve communicable with the secondary fuel source and operable to control supply of the secondary fuel to the second float bowl. Primary fuel can be supplied to the low pressure zone through a fuel nozzle communicating between the first float bowl and the low pressure zone. Primary fuel can be supplied to the cavity through a conduit connecting the first float bowl in communication with the cavity.

In another embodiment, the fuel supply system includes a primer pump having an inlet connected in communication with the second float bowl and an outlet connected in communication with a priming fuel port opening into the induction passage for selectively introducing a quantity of the secondary fuel into the induction passage.

One of the principal features of the invention is the provision of a dual fuel supply system for an internal combustion engine having the capability of reducing the amount of the more expensive fuel required for operating the engine at idle and part throttle.

Another of the principal features of the invention is the provision of such a duel fuel supply system which is arranged to supply a blend of the less expensive primary fuel and the more expensive secondary fuel to the engine at idle and part throttle operations, as well as at full throttle operation.

Other features, aspects and advantages of the invention will become apparent to those skilled in the art upon reviewing the following detailed description, the drawing and the appended claims.

BRIEF DESCRIPTION OF THE DRAWING

The single FIGURE is a schematic view of a dual fuel supply system embodying various of the features of the invention.

Before explaining at least one embodiment of the invention in detail, it is to be understood that the invention is not limited in its application to the details of construction and the arrangement of components set forth in the following description or illustrated in the drawing. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated in the drawing is a fuel supply system 10 for an internal combustion engine (not shown) included in an outboard motor or the like. The fuel supply system 10 is arranged to permit engine operation with two different fuels, for example, an inexpensive first or primary fuel, such as kerosene, and a more expensive second or secondary fuel, such as gasoline. The system is arranged so that the two fuels are blended and supplied to the engine during idling, as well as during low and normal speed operations. The system is also arranged so that the secondary fuel can be used to prime the engine to facilitate starting.

The fuel supply system 10 includes a carburetor 12 having a fuel/air induction passage 14 communicating with the engine fuel intake (not shown). The fuel/air induction passage 14 includes a venturi 16 having a throat defining a low pressure zone 18. Mounted downstream of the venturi 16 is a throttle valve 20 which is movable between open and closed positions to control the flow of fuel and air through the fuel/air induction passage 14 and thus engine speed.

Located in the wall of the fuel/air induction passage 14 adjacent the periphery of the throttle valve 20 is one or more secondary orifices 22, each of which communicates with a fuel cavity or well 24 in the carburetor 12. The carburetor 12 includes a fuel duct or passage 26 through which fuel is supplied to the fuel well 24. The flow of fuel through the fuel passage 26 to the fuel well 24 is controlled by a needle valve 28.

The carburetor 12 includes a first or primary fuel chamber or float bowl 30. A primary fuel, such as kerosene, is supplied to the float bowl 30 from a source 31 of the primary fuel via an inlet hose or conduit 32 and a fuel pump 33 or other suitable means.

Flow of the primary fuel to the float bowl 30 is controlled by a valve 34 which is connected to a float 36 and opens and closed in response to movement of the float 36. Thus, the valve 34 and float 36 serve to maintain a predetermined level of the primary fuel in the float bowl 30.

The carburetor 12 includes a vent 37 through which the float bowl 30 is vented to the atmosphere.

Primary fuel is supplied from the float bowl 30 to the low pressure zone 18 through a fuel nozzle 38 extending between the float bowl 30 and the low pressure zone 18. More specifically, the carburetor 12 includes a depending hollow boss 40 which extends into the float bowl 30 with the lower end below the normal fuel level 42. The lower end of the boss 40 is closed by an orifice plug 44 and the fuel nozzle 38 extends into the boss 40 above the orifice plug 44. The carburetor 12 also includes a needle valve 45 for adjusting fuel flow from the float bowl 30 to the fuel nozzle 38.

Primary fuel is supplied from the float bowl 30 to the fuel passage 26 by a pick-up conduit or tube 46 which extends between the float bowl 30 and the fuel passage 26. While other arrangements can be used, in the specific construction illustrated, the pick-up tube 46 is located inside the fuel nozzle 38 and an annular flow passage 49 is defined therebetween.

The fuel supply system also includes a housing 50 defining a secondary fuel chamber or float bowl 52. A secondary fuel, such as gasoline, is supplied to the float bowl 52 from a source 54 of the secondary fuel via an inlet hose or conduit 56 and a fuel pump 58 or other suitable means. Flow of the secondary fuel into the float bowl 52 is controlled by a valve 60 which is connected to a float 62 and opens and closed in response to movement of the float 62. Thus, the valve 60 and the float 62 serve to maintain a predetermined level of the secondary fuel in the float bowl 52.

The top portion of the housing 50 includes a vent 63 through which the float bowl 52 is vented to the atmosphere.

Secondary fuel is supplied from the float bowl 52 to the fuel passage 26 via a tube or conduit 64 connected to and extending between an outlet 66 in the housing 50 and a fuel inlet port 68 on the carburetor 12 communicating with the fuel passage 26. An orifice 70 in the fuel inlet port 68 restricts flow of the secondary fuel into the fuel passage 26.

The fuel supply system 10 can also include a conventional plunger-operated primer pump 72 for supplying a small amount of the secondary fuel into the fuel/air induction passage to facilitate engine starting. The primer pump 72 includes an external stem 74, an inlet 76 connected in communication with the housing outlet 66 via a tube or conduit 78, and an outlet 80 connected in communication with the fuel/air induction passage 14 via a tube or conduit 82. While the priming fuel can be introduced into the fuel/air induction passage 14 at various locations, in the specific construction illustrated, a priming fuel port 84 communicating with the fuel/air induction passage 14 is provided downstream of the throttle valve 20 and the conduit 82 is connected to the priming fuel port 84.

Assuming that kerosene and gasoline are used as the primary and secondary fuels, respectively, the engine can be primed to facilitate starting by depressing the stem 74 on the primer pump 72. This will supply a flow of gasoline from the float chamber 52 into the fuel/air induction passage 18 through the priming fuel port 84.

As the engine cranks, during starting or normal operations, a flow of gasoline is induced from the float bowl 52, through the fuel passage 26 into the fuel well 24, and from the fuel well 24 through the secondary orifices 22 into the fuel/air induction passage 18. At the same time, a flow of kerosene is induced from the float bowl 30, through the pick-up tube 46 and the fuel passage 26 into the fuel well 24, from the fuel well 24 (after mixing or blending with the gasoline), through the secondary orifices 22 and into the fuel/air induction passage 18. Also at the same time, a flow of kerosene is induced from the float chamber 30 through the annular passage 46 between the pick-up tube 46 and the fuel nozzle 38 and into the low pressure zone 18. Thus, once the engine is started, a blend of the primary fuel (kerosene) and the secondary fuel (gasoline) is provided during idle, part throttle and full throttle operations.

This blending allows the engine to operate on a lesser amount of the more expensive secondary fuel and, therefore, reduces cost of operation as compared to prior dual fuel systems which employ only the secondary fuel for the starting and/or idling operation. The mixture ratio of the blended fuel in the fuel well depends on the flow resistance in the primary and secondary fuel systems between the fuel well and the respective float chambers.

Various of the features of the invention are set forth in the following claims.

We claim:

1. A fuel supply system comprising a carburetor including an fuel/air induction passage having means defining a low pressure zone, a secondary orifice communicating with said induction passage downstream of said low pressure zone, a cavity communicating with said secondary orifice, first fuel supply means including a source of a first fuel and means operable to simultaneously supply the first fuel to said low pressure zone and to said cavity, and second fuel supply means including a source of a second fuel and means operable to supply the second fuel to said cavity simultaneously with the first fuel.

2. A fuel supply system according to claim 1 wherein said first fuel supply means includes a first float bowl communicating with said low pressure zone and with said cavity and a first float controlled valve communicable with the first fuel source and operable to control the supply of the first fuel to said first float bowl, and wherein said second fuel supply includes a second float bowl communicating with said cavity and a second float controlled valve communicable with the second fuel source and operable to control the supply of the second fuel to said second float bowl.

3. A fuel supply system according to claim 2 including a fuel nozzle communicating between said first float bowl and said low pressure zone and a conduit connecting said first float bowl in communication with said cavity.

4. A fuel supply system according to claim 1 wherein said carburetor includes a throttle valve located downstream of said low pressure zone and a priming fuel port located downstream of said throttle valve and communicating with said induction passage.

5. A fuel supply system according to claim 4 including a primer pump having an inlet connected in communication with said second fuel source and an outlet connected in communication with said priming fuel port for selectively introducing a quantity of the second fuel into said induction passage through said priming fuel port.

6. A fuel supply system comprising a carburetor including a fuel/air induction passage having means defining a low pressure zone and a secondary orifice communicating with said induction passage downstream of said low pressure zone, a cavity communicating with said induction passage through said secondary orifice, first fuel supply means including a first fuel bowl connected to a source of a first fuel, a first float controlled valve operable to control the supply of the first fuel to said first float bowl, a fuel nozzle communicating between said first float bowl and said low pressure zone, and a conduit communicating said first float bowl with said cavity such that the first fuel is simultaneously supplied to said pressure zone and to said cavity, and second fuel supply means including a second float bowl communicating with said cavity and connected to a source of a second fuel, and a second float control valve operable to control the supply of the second fuel to said second float bowl such that the first and second fuels are blended together in said cavity prior to introduction into said induction passage.

7. A fuel supply system according to claim 6 wherein said carburetor includes a throttle valve located downstream of said low pressure zone and a priming fuel port located downstream of said throttle valve and communicating with said induction passage, and wherein said system further includes a primer pump having an inlet connected in communication with said second float bowl and an outlet connected in communication with said priming fuel port for selectively introducing a quantity of the second fuel into said induction passage through said priming fuel port.

8. A fuel supply system comprising a carburetor including an fuel/air induction passage having therein a throttle valve, a secondary orifice communicating with said air induction passage adjacent to said throttle valve, first fuel supply means including a source of a first fuel and means operable to simultaneously supply the first fuel to said secondary orifice and to said induction passage upstream of said throttle, and second fuel supply means including a source of a second fuel and means operable to supply the second fuel to said secondary orifice simultaneously with the first fuel.

9. A fuel supply system according to claim 8 wherein said first fuel supply means includes a first float bowl communicating with said air induction passage and with said secondary orifice and a first float controlled valve communicable with the first fuel source and operable to control the supply of the first fuel to said first float bowl, and wherein said second fuel supply includes a second float bowl communicating with said secondary orifice, and a second float controlled valve communicable with the second fuel source and operable to control the supply of the second fuel to said second float bowl.

10. A fuel supply system comprising a carburetor including a fuel/air induction passage having therein a throttle valve, and a secondary orifice communicating with said induction passage adjacent to said throttle valve, first fuel supply means including a first fuel bowl connected to a source of a first fuel, a first float controlled valve operable to control the supply of the first fuel to said first float bowl, a fuel nozzle communicating between said first float bowl and said air induction passage upstream of said throttle valve, and a conduit communicating said first float bowl with said secondary orifice such that the first fuel is simultaneously supplied to said fuel nozzle and to said secondary orifice, and second fuel supply means including a second float bowl communicating with said secondary orifice and connected to a source of a second fuel, and a second float control valve operable to control the supply of the second fuel to said second float bowl such that the first and second fuels are simultaneously supplied to said secondary orifice for introduction into said induction passage.

* * * * *